US005713753A

United States Patent [19]

Bayer et al.

[11] Patent Number: 5,713,753

[45] Date of Patent: Feb. 3, 1998

[54] PLUG CONNECTOR

[76] Inventors: Thomas K. Bayer, 346 Creek Road, St. David's, Ontario, Canada, L0S 1P0; Dennis O. R. Beamer, 666 Vine Street, St. Catharines, Ontario, Canada, L2M 7L8

[21] Appl. No.: 679,009

[22] Filed: Jul. 12, 1996

[51] Int. Cl.[6] ..... H01R 13/62

[52] U.S. Cl. ..... 439/369

[58] Field of Search ..... 439/369, 367, 439/368, 370

[56] References Cited

U.S. PATENT DOCUMENTS

| | | | |
|---|---|---|---|
| 3,030,601 | 4/1962 | Krebs | 439/369 |
| 3,871,731 | 3/1975 | LaCoursiere, Sr. et al. | 439/367 |
| 5,584,720 | 12/1996 | Elswick | 439/368 |

*Primary Examiner*—Khiem Nguyen
*Assistant Examiner*—Yong Ki Kim
*Attorney, Agent, or Firm*—James W. Carson

[57] ABSTRACT

The present invention relates to an apparatus to provide a secure connection between the male plug and female receptacle on adjoining electrical cords which prevents the plug from separating from the receptacle by forcing the plug and the receptacle together. The apparatus comprises a pair of opposing body portions, each of said body portions having an interior and an exterior end. The body portions preferably consist of a pair of co-axial cones with generally flat opposing bases. A centrally disposed longitudinal conduit is provided through said body potions and opens on said interior and exterior ends of said body portions. Elastic means link said body portions so that said body portions are biased towards each other when said elastic means is stretched to separate the body potions. The elastic means preferably comprise a plurality of lining members attaching the interior ends of said body portions. The lining members are preferably equip-spaced about the periphey of the interior ends of said body portions wherein the generally flat opposing faces of said body portions are maintained in contact with said male plug and female receptacle. The linking members are preferably integrally molded with the body portions. Means are provided to permit said electrical cords to be inserted into the longitudinal conduits in said body potions such that the male plug and female receptacle are contained between the body portions to prevent separation of the male plug and female receptacle. The means preferably consists of a longitudinal slit in said body potions.

5 Claims, 3 Drawing Sheets

PLUG CONNECTOR

BACKGROUND OF THE INVENTION

1. Field of the Invention

This invention relates to a male plug and female receptacle connection between electrical cords. In particular the present invention provides apparatus to retain the male plug within the female receptacle.

2. Description of the Prior Art

A typical non-locking connection between electrical cords relies on friction to secure the male plug within the female receptacle. As such, the quality of the connection is largely determined by the fit of the plug to the receptacle. Further, as the cords age, the quality of the connection deteriorates. Another problem with the connection is its exposure to the environment, wherein water and other conductive elements may enter the connection and short circuit the electrical circuit.

In order to ensure a secure connection, a common practice is to wind tape or wire around the connection, thereby binding the plug and receptacle together. However, such practice is time consuming and does not provide easy disconnection of the plug from the receptacle. Another common practice is to loop the connection within a knot in the electrical cords, thereby reducing the longitudinal stresses on the connection. However, due to the knot, additional lateral stresses are placed on the connection and the knot easily snags on nearby objects.

SUMMARY OF THE INVENTION

It is an object of the invention to provide a simple and secure connection between the male plug and female receptacle on joining electrical cords.

It is a further object of the invention to provide a means for preventing the separation of the plug and receptacle without knotting the cords.

It is a further object of the invention to provide a device that will not snag on obstacles.

Thus in accordance with the present invention there is provided apparatus to provide a secure connection between the male plug and female receptacle on adjoining electrical cords which prevents the plug from separating from the receptacle by forcing the plug and the receptacle together. The apparatus comprises a pair of opposing body portions, each of said body portions having an interior and an exterior end. The body portions preferably consist of a pair of co-axial cones with generally flat opposing bases. A centrally disposed longitudinal conduit is provided through said body portions and opens on said interior and exterior ends of said body portions. Elastic means link said body portions so that said body portions are biased towards each other when said elastic means is stretched to separate the body portions. The elastic means preferably comprise a plurality of linking members attaching the interior ends of said body portions. The linking members are preferably equip-spaced about the periphery of the interior ends of said body portions wherein the generally flat opposing faces of said body portions are maintained in contact with said male plug and female receptacle. The linking members are preferably integrally molded with the body portions but may also include mechanical means such as turnbuckles, hinges, sheaths, rods and springs. Means are provided to permit said electrical cords to be inserted into the longitudinal conduits in said body portions such that the male plug and female receptacle are contained between the body portions to prevent separation of the male plug and female receptacle. The means preferably consists of a longitudinal slit in said body portions.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
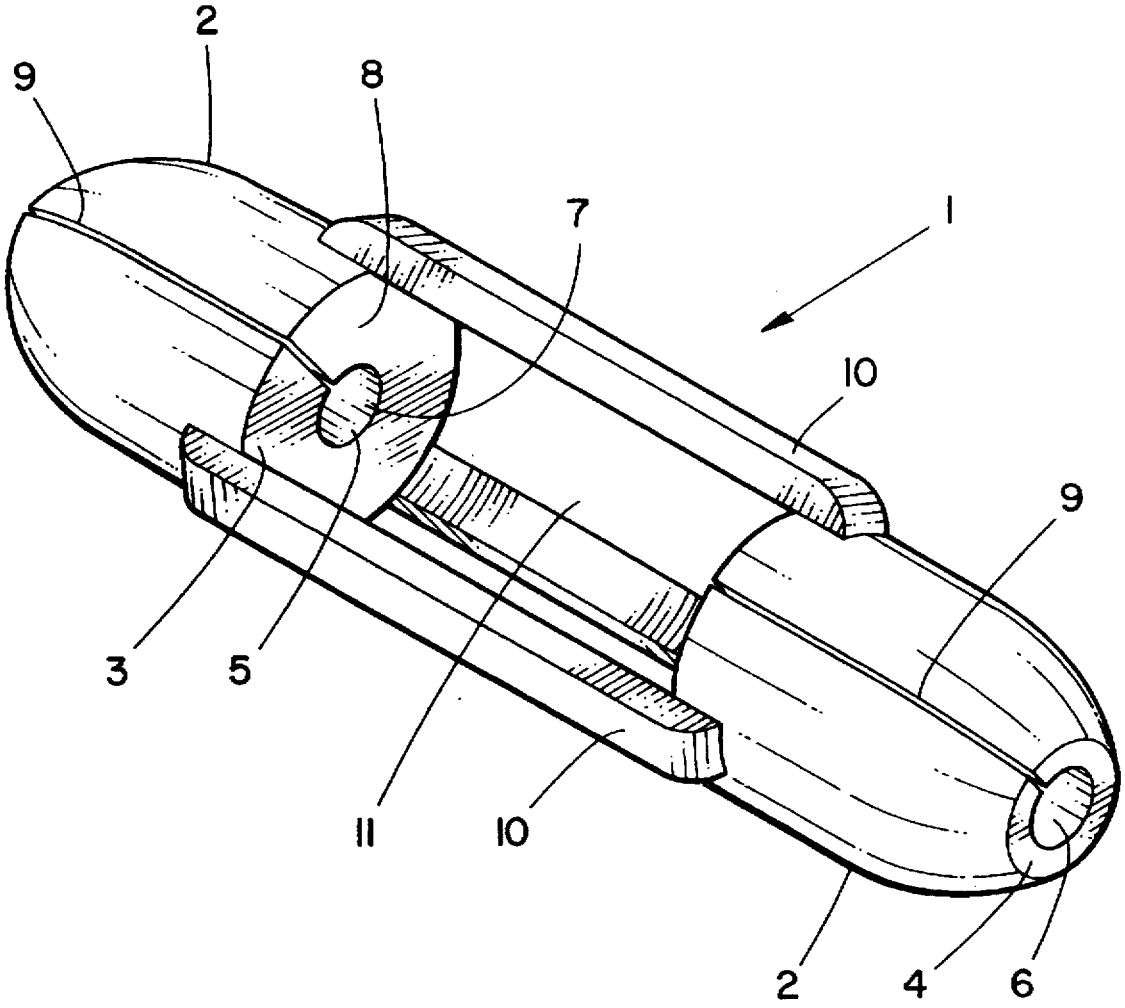
FIG. 1 is a perspective view of a plug connector according to the present invention for securing the plug and receptacle of a pair of electrical cords.
Figure 2:
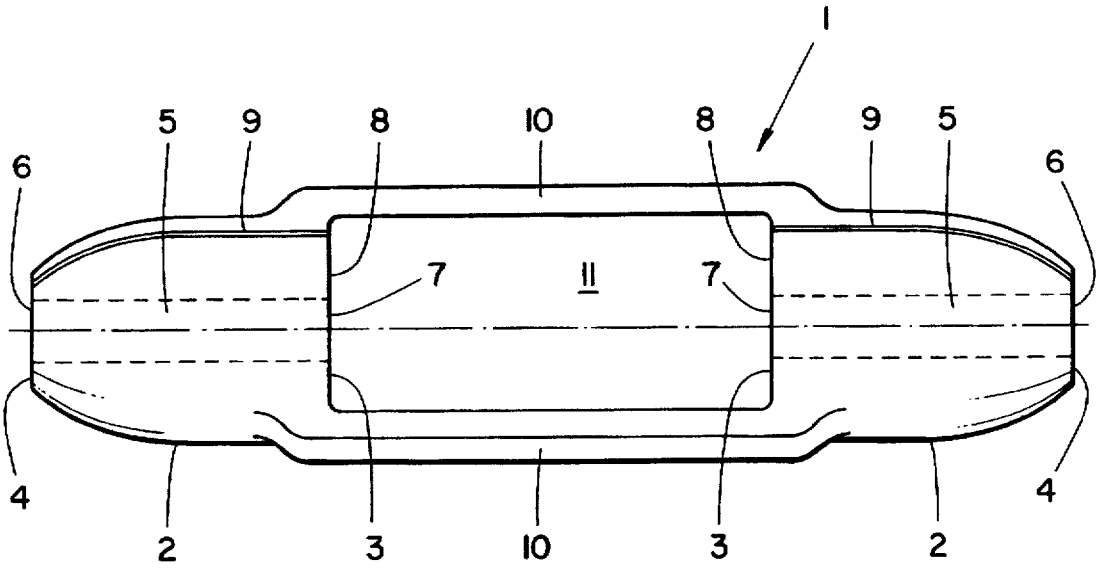
FIG. 2 is a lateral plan view of the plug connector of FIG. 1.
Figure 3:
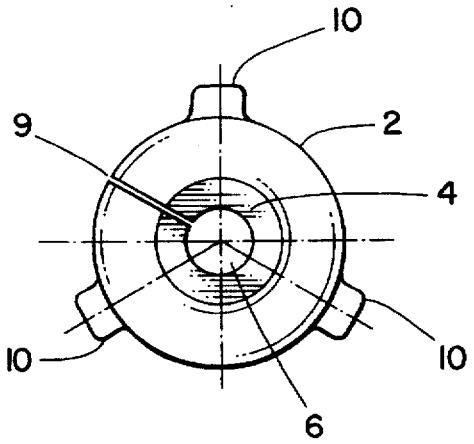
FIG. 3 is a right end plan view of the plug connector of FIG. 2.

Referring to FIGS. 1 to 5, a plug connector according to the present invention is generally indicated at 1. The plug connector 1 comprises a pair of opposing body portions 2 each having an interior end 3 and exterior end 4. A centrally disposed longitudinal conduit 5 having an exterior opening 6 and interior opening 7 is provided in each body portion 2. In the preferred embodiment illustrated in FIG. 1 the body portions 2 are shown as a pair of co-axial cones with generally flat opposing bases 8. By utilizing a cone configuration for body portions 2 a streamlined design can be obtained that reduces the chance of the plug connector snagging or hanging up on obstructions as the cords are pulled around a job site or the like. The bases 8 are preferably flat to accommodate the greatest range of plug shapes. However other configurations are within the scope of the invention (convex etc.) provided the bases or other part of the body portions (if body portions in form of a conical sleeve or helix for example) are able to maintain contact and provide an even pressure to the plug and receptacle to secure the connection. While the preferred embodiment illustrates body portions 2 as utilizing a cone configuration other shapes can be utilized and are included within the scope of the present invention. The conduits 5 are sized to accommodate an electrical cord.

Figure 4:
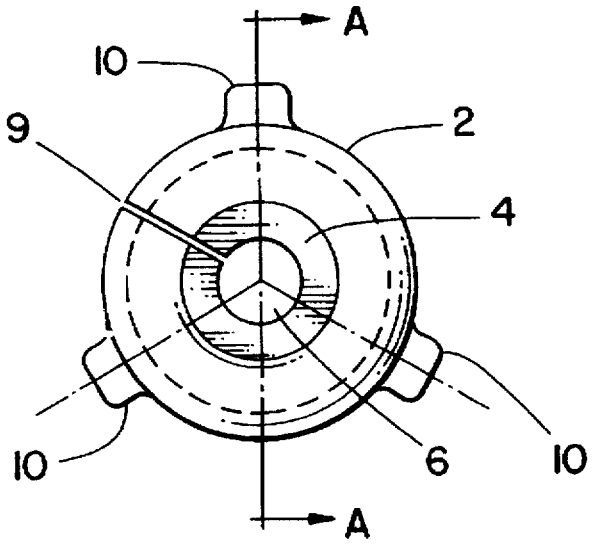
FIG. 4 is an end plan view of pan of the right side body portion of another embodiment of the plug connector according to the present invention.
Figure 5:
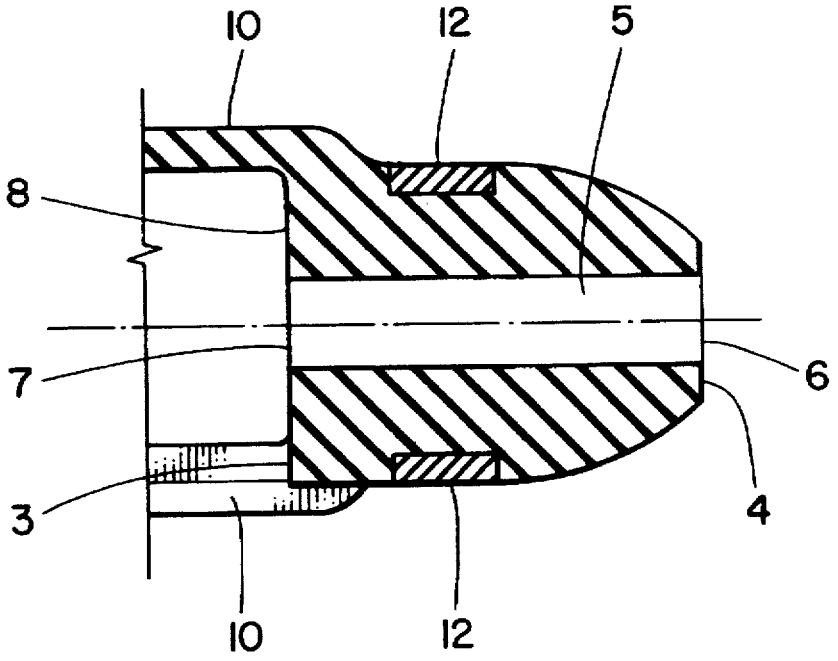
FIG. 5 is a cross section along line A—A of the body portion of FIG. 4.

Means are provided in the body portions 2 to permit the insertion and removal of electrical cords (not shown) into conduits 5. In the preferred embodiment longitudinal slits 9 are provided in body portions 2 to allow insertion and removal of the electrical cord from conduits 5. The slits may be straight, stepped, curved, helical or "snake" shaped. In the latter two configurations there is a tendency for slits 9 to be biased in a closed position preventing the electrical cords from accidentally becoming removed from conduits 5. Alternatively, as shown in FIGS. 4–5, means can be provided to insure the cord cannot accidentally be removed through slit 9. In the embodiment illustrated this means comprises ring 12 attached around the circumference of body portion 2. Ring 12 provides closure support for slit 9.

Once the electrical cord is located inside longitudinal conduit 5 ring 12 urges slit 9 to close preventing the cord from accidentally being removed from conduit 5. Alternatively the ring can be adapted to rotate to cover the slit. The ring 12 is preferably made from a non-metallic flexible material and can be molded into an annular slot in body portion 2 or contained in a recess which can be plain, stepped or dovetailed that is molded into the circumference of body portion 2.

Body portions 2 are joined together by means that biases the opposing bases 8 towards each other and provides a space to accommodate the male plug and female receptacle of two electrical cords being joined together. In the preferred embodiment this means comprises a plurality of elastic linking members 10. Space 11 defined by the interior ends 3 of the body portions 2 and linking members 10 is sized to contain the male plug and female receptacle of the electrical cords. In the preferred embodiment three linking members 10 are shown evenly spaced around the circumference of the interior ends 3 of body portions 2. If the linking members are helical rather than straight, slits 9 could be offset in each of the body portions. In order to ensure a tight fit between the opposing bases 8 and the male plug and female receptacle, linking members 10 are of sufficient length to allow the plug and receptacle to fit tightly in space 11. In the preferred embodiment the body portions 2 and linking members 10 are molded in one piece preferably of a resilient non-conductive material similar to neoprene with a durometer reading of 50. The flat opposing bases 8 of the body portions 2 apply pressure to the rear surfaces of both the plug and receptacle preventing their separation. While the linking members are preferably integrally molded with the body portions it may also include mechanical means such as turnbuckles, hinges, sheaths, rods and springs that can be used to expand the space between the body portions to insert the plug and receptacle and then tightened to maintain pressure on them. Alternatively the body portions could be two separate pieces with linking members connected to them by T-stops or other suitable means of connection. In the preferred design the linking members are connected to the body portions so that there are no protrusions that could get snagged or hung up as the cords are pulled around the work area.

The inventors have determined that body portions of about 2 inches long and a 1.5 inches diameter base spaced about 3 inches apart by the linking members accommodates a majority of plug sizes and shapes. The linking members can be stretched to insert the plugs and then will have a tendency to revert back to their starting position thereby maintaining pressure on the plug/receptacle combination. A conduit having a diameter of about 0.42 inches accommodates most electrical cords.

To secure the connection between electrical cords using the present invention, the male plug on one electrical cord is inserted into the female receptacle on another electrical cord, thereby creating an electrical connection. The connected male plug and female receptacle are inserted into space 11 between the opposing faces 8 of body portions 2 and linking members 10. The elasticity of the linking members 10 permits space 11 to be stretched to accommodate the plug/receptacle connection. The electrical cords are then inserted into conduits 5 through slits 9. Finally, any slack in the cords within space 11 is pulled through exterior openings 6 until the connection is located tightly within space 11. It is possible to insert the cords into the conduits first, then connect the plug and receptacle.

Having illustrated and described a preferred embodiment of the invention and certain possible modifications thereto, it should be apparent to those of ordinary skill in the art that the invention permits of further modification in arrangement and detail. All such modifications are covered by the scope of the invention.

The embodiments of the inventions in which an exclusive property or privilege is claimed are defined as follows:

1. Apparatus to provide a secure connection between a male plug and a female receptacle on adjoining electrical cords, said apparatus comprising a pair of co-axial cones, each of said cones having an interior and an exterior end and having generally flat opposing bases on said interior end of each of said cones, a centrally disposed longitudinal conduit through said cones and having openings on the interior and exterior ends of said cones, a plurality of elastic linking members connecting the interior ends of said cones whereby said cones are biased towards each other, and a longitudinal slit in said cones to permit the electrical cords to be inserted into the longitudinal conduits in said cones such that the male plug and female receptacle are contained between the generally flat opposing bases of said cones and are maintained in contact with said opposing bases to prevent separation of said male plug and female receptacle and wherein said cones and linking members are moulded in one piece of resilient non-conductive material.

2. Apparatus according to claim 1 wherein three linking members are equip-spaced about the interior ends of said cones.

3. Apparatus according to claim 1 wherein said slit is straight, stepped, curved, helical or snake shaped.

4. Apparatus according to claim 3 wherein means are provided to prevent accidental removal of the said electrical cords from said conduits.

5. Apparatus according to claim 4 wherein said means consists of a nonmetallic flexible insert or ring molded in or mounted on said body portions that biases the slit in the closed position or can be rotated to cover said slit.

* * * * *